US007784633B2

(12) United States Patent
Luburic

(10) Patent No.: US 7,784,633 B2
(45) Date of Patent: Aug. 31, 2010

(54) CONTAINER AND LID AND RELATED METHOD

(75) Inventor: Frano Luburic, Anaheim Hills, CA (US)

(73) Assignee: Ropak Corporation, Fountain Valley, CA (US)

( * ) Notice: Subject to any disclaimer, the term of this patent is extended or adjusted under 35 U.S.C. 154(b) by 0 days.

(21) Appl. No.: 11/788,938

(22) Filed: Apr. 23, 2007

(65) Prior Publication Data

US 2008/0257886 A1 Oct. 23, 2008

(51) Int. Cl.
*B65D 43/26* (2006.01)
*B67B 7/44* (2006.01)

(52) U.S. Cl. ..... 220/285; 220/266; 220/793; 215/304; 81/3.15

(58) Field of Classification Search ..... 220/266, 220/285, 793; 215/216, 303, 304; 81/3.15
See application file for complete search history.

(56) References Cited

U.S. PATENT DOCUMENTS

| | | | | | |
|---|---|---|---|---|---|
| 812,257 | A * | 2/1906 | Booth | ..... | 215/302 |
| 3,128,004 | A * | 4/1964 | Soffer | ..... | 220/285 |
| 3,661,292 | A * | 5/1972 | Chappell | ..... | 220/285 |
| 3,744,655 | A * | 7/1973 | Nixdorff, Jr. | ..... | 215/216 |
| 4,165,014 | A * | 8/1979 | Ruscitti | ..... | 220/266 |
| 5,297,688 | A * | 3/1994 | Beck et al. | ..... | 215/344 |
| 6,644,492 | B1 | 11/2003 | Mitchell | | |
| 6,763,960 | B2 * | 7/2004 | Oh | ..... | 215/201 |

* cited by examiner

*Primary Examiner*—Anthony Stashick
*Assistant Examiner*—James N Smalley
(74) *Attorney, Agent, or Firm*—McKenna Long & Aldridge LLP

(57) ABSTRACT

A device used to aid in the opening of a container that further protects against the inadvertent opening of the container, as well as provides greater hoop strength when compared to similar containers for use in, among other things, the containment, storage, transport and/or handling of a material, is described herein.

15 Claims, 3 Drawing Sheets

CONTAINER AND LID AND RELATED METHOD

FIELD OF THE INVENTION

The present invention relates generally to containers, and more particularly, the present invention relates to a device used to aid in the opening of a container that further protects against the inadvertent opening of the container, as well as provides greater hoop strength when compared to similar containers for use in, among other things, the containment, storage, transport and/or handling of a material.

INCORPORATION BY REFERENCE

The contents of each U.S. patent or other references, if any, cited in this application, are hereby incorporated by reference.

BACKGROUND OF THE INVENTION

As disclosed in U.S. Pat. No. 6,644,492 issued Nov. 11, 2003 to Mitchell, containers that include lids have numerous uses in residential, industrial, and commercial applications. In many applications, a snug or airtight engagement between the lid and the container is desirable to ensure that the contents of the container does not spoil through exposure to the air, or spill if the container is dropped or knocked over. In this regard, the Mitchell patent provides a closure displacement lever for improved disengagement of the lid from the container. As shown in the preferred embodiment of the Mitchell drawings, that lever includes a lowermost gripping edge, by which a user can engage the lever, pull it outwardly, and use it to help pry off a cover or lid from the container. The Mitchell patent generally provides a container having a base and a rim connected by a circumferential wall. A lid having a skirt is included for engaging the rim of the container. A flange is further provided on the container surrounding the circumferential wall with the lever forming a part of the flange, where the flange is discontinuous at either side of the lever, so that the lever is flush with and conforms to the shape of the flange.

Although the Mitchell device is generally well suited to facilitate disengagement of the lid from the container, the flange, being discontinuous at either side of the lever exposes the bottom, lower, or free edge of lever to the user. As such, the arrangement between the lever and flange of the Mitchell device does not prevent or even minimize the potential for inadvertent opening of the container.

Accordingly, it is desirable to provide a method and apparatus that provides for at least a device used to aid in the opening of a container, that further protects against the inadvertent opening of the container, as well as provides greater hoop strength when compared to similar containers.

SUMMARY OF THE INVENTION

For the purpose of summarizing the invention certain objects and advantages have been described herein. It is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

The present invention relates generally to containers, and more particularly, the present invention relates to a device used to aid in the opening of a container that further protects against the inadvertent opening of the container, as well as provides greater hoop strength when compared to similar containers for use in, among other things, the containment, storage, and/or transport of a material.

In one embodiment, the present invention includes a container having a base or bottom portion, and a rim or top portion defining an opening to the container. A container body connects the base and the rim. The container further includes a closure displacement lever formed on the body of the container for disengaging a lid that is configured to engage the rim or top portion of the container. A flange, generally for handling (lifting, carrying, or generally maneuvering) the container is preferably provided on the container. The flange is configured to prevent or at least minimize the potential for inadvertent opening of the container. In this regard, in one embodiment, a portion of the flange or separate piece of material is preferably positioned a distance below the lever in such a way as to prevent activation or operation of the lever during handling of the container in activities not intended to disassociate the lid from the container while permitting manipulation of the lever by a user when intending to disengage the lid from the container.

These and other embodiments will become readily apparent to those skilled in the art from the following detailed description of the preferred embodiments having reference to the attached figures, the invention not being limited to any particular preferred embodiment(s) disclosed.

DETAILED DESCRIPTION

Figure 2:
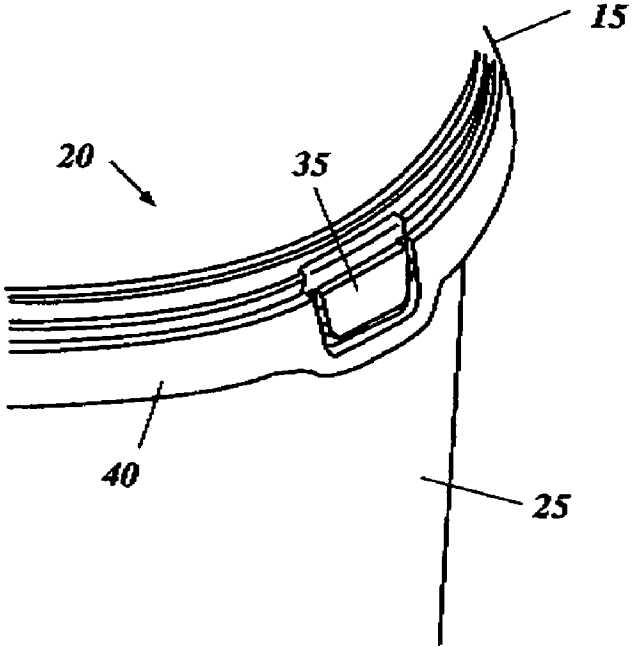
FIG. 2 shows a view of the container base, rim, body, flange and its associated closure displacement lever of FIG. 1.

Embodiments of the present invention will now be described with references to the accompanying Figures, wherein like reference numerals refer to like elements throughout. The terminology used in the description presented herein is not intended to be interpreted in any limited or restrictive manner, simply because it is being utilized in conjunction with a detailed description of certain embodiments of the invention. Furthermore, various embodiments of the invention (whether or not specifically described herein) may include novel features, no single one of which is solely responsible for its desirable attributes or which is essential to practicing the invention herein described.

The present invention relates generally to containers, and more particularly, the present invention relates to a device used to aid in the opening of a container that further protects against the inadvertent opening of the container, as well as provides greater hoop strength when compared to similar containers for use in, among other things, the containment, storage, and/or transport of a material. Persons of ordinary skill in the art will understand that although the present invention is depicted in the figures as being associated with a substantially round container, the present invention may be adapted or utilized with containers having a variety of shapes (oval, square, rectangle) and sizes.

Figure 1:
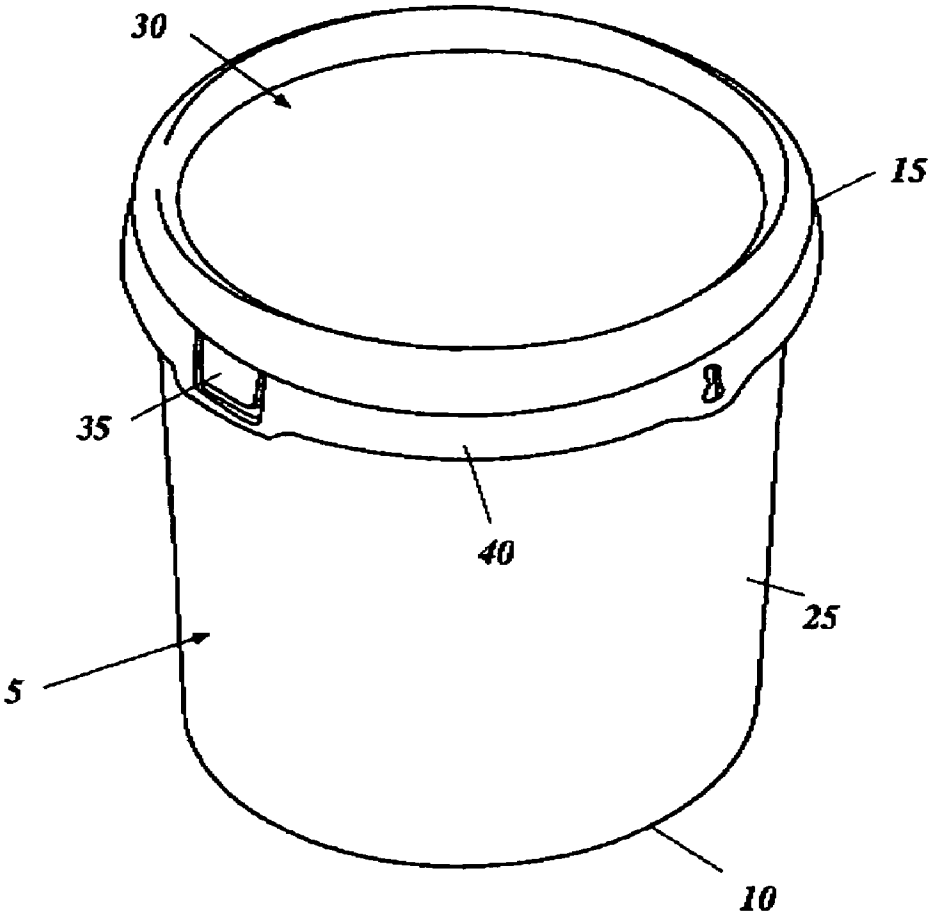
FIG. 1 shows a container having a base, a rim, a body connecting the base and rim, a continuous flange with an associated closure displacement lever, and a lid in accordance one embodiment of the present invention.

As shown in FIG. 1 and FIG. 2, in one embodiment, the present invention includes a container 5 having a base or bottom portion 10, a rim or top portion 15 defining an opening 20 to the container 5, and a container body 25 connecting the base and the rim. The container further includes a corresponding lid or closure 30 configured to engage the rim or top portion 15 of the container 5, a closure displacement lever 35 formed on the body 25 for disengaging the lid 30 from the container 5, and an associated flange 40 generally provided for handling (lifting, carrying, or generally maneuvering) the container.

Figure 4:
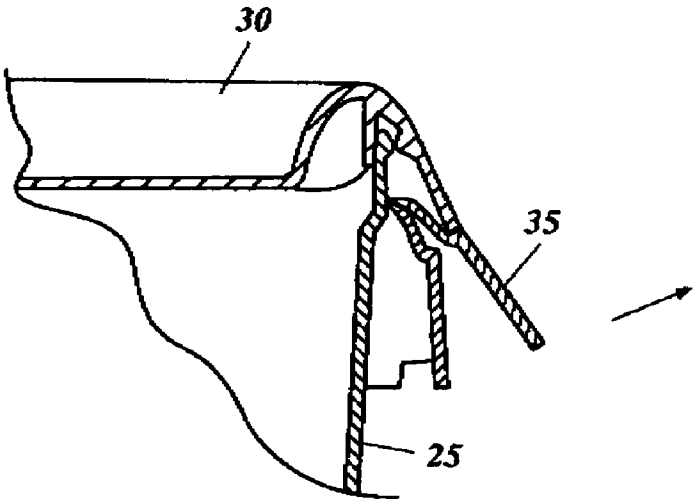
FIGS. 3-5 show a partial cross-sectional view of one side of a typical closure displacement lever proceeding in the figures from a closed position to a position where the lid or closure is substantially removed from the container.
Figure 5:
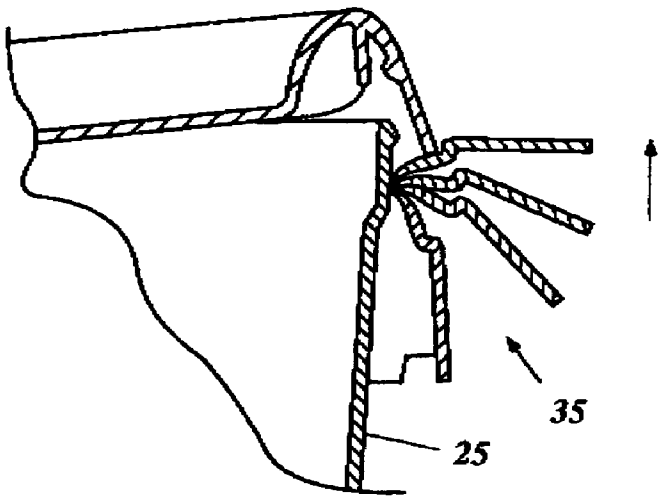
Figure 3:
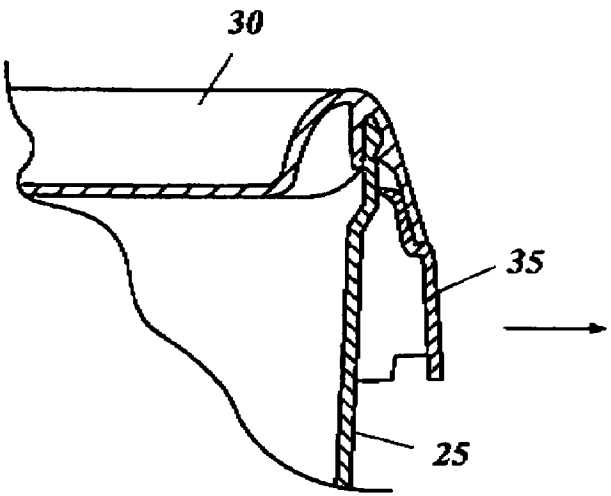
Figure 7:
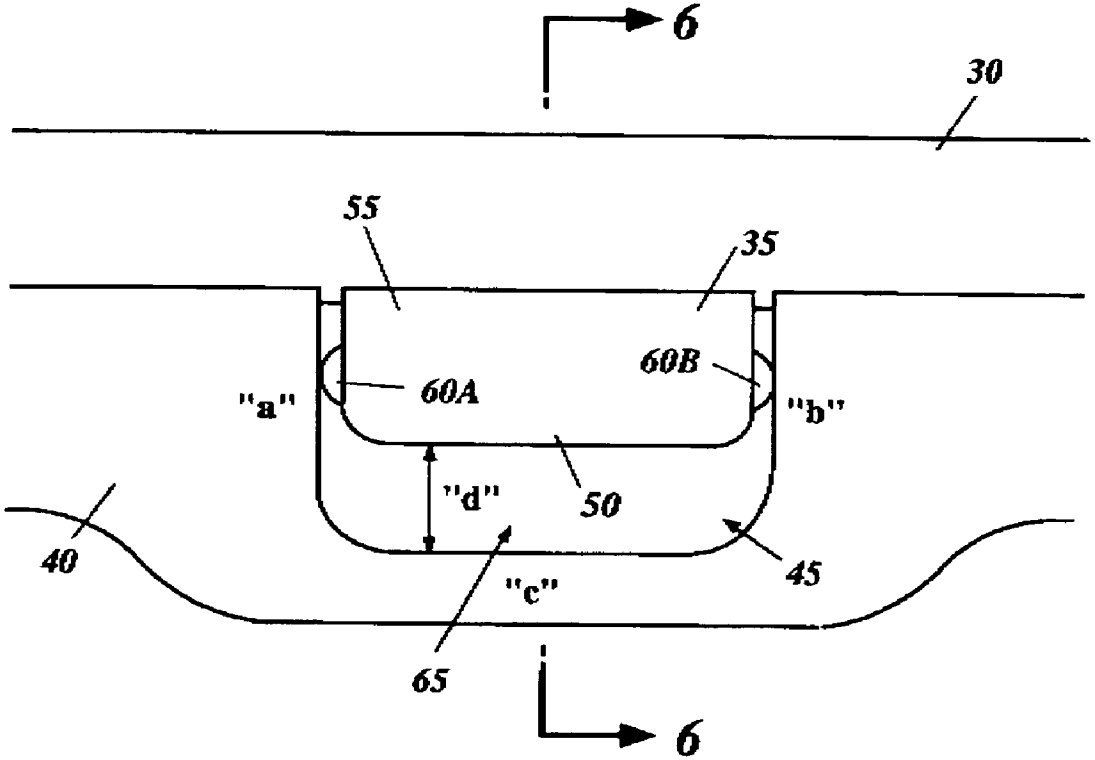
FIG. 7 shows the flange and the associated closure displacement lever of FIG. 6.
Figure 6:
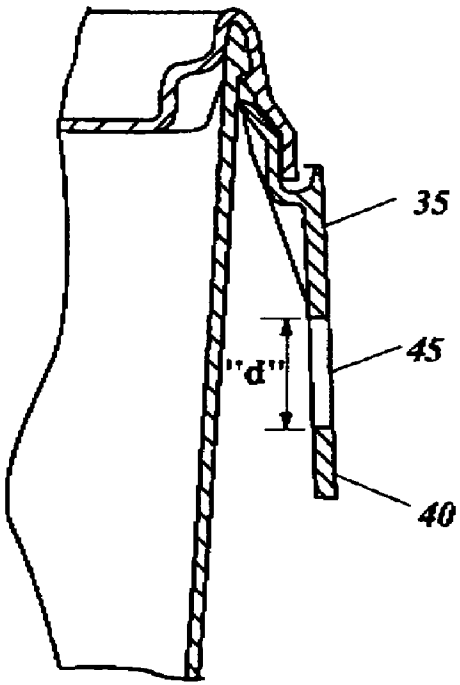
FIG. 6 shows a cross-section of a flange and its associated closure displacement lever in accordance with one embodiment of the present invention.

FIGS. 3-5 show the basic structural configuration of the closure displacement lever 35 of the present invention and the operable characteristics of the lever 35 relative to the container 5 and the lid 30. In this regard, the present invention's lever structure, function, and operation remain substantially the same as those of the lever disclosed and described in the aforementioned Mitchell '492 patent. However, a comparison of FIGS. 3-5 with FIGS. 6-7 shows that the present invention further includes a flange 40 associated with the lever 35 and configured to prevent or at least minimizes the potential for inadvertent opening of the container 5, as well as provide greater hoop strength when compared to similar containers.

In this regard, a portion of the flange 40 is preferably positioned a distance "d" below the lever 35 in such a way as to prevent activation or operation of the lever 35 during handling of the container 5 in activities not intended to disassociate the lid 30 from the container 5 while permitting manipulation of the lever 35 by a user when intending to disengage the lid 30 from the container 5.

As shown in FIG. 1, in one embodiment, the flange 40 may be formed as a continuous unbroken or uninterrupted structure about the entire periphery of the container 5. In this embodiment, the lever 35 may be considered as being positioned within an open-well, or a U-shaped housing or cutout 45. Although the shape of the "well/cutout 45" can be any of a wide variety and range, in FIG. 1 it is defined by opposite sides "a", "b" of the flange 40 and a lower flange piece "c" connecting the two flange sides "a", "b". More specifically, the lever 35 preferably has a first, lower, or free end 50 that may be grasped and manipulated by a user, and a second or connected end 55 that is pivotally attached to the container body 25. Again, the precise shape of the lever 35 and its free end 50, connected ends 60A, 60B, can be any of a wide range, depending on the application, materials used, and other factors.

Tamper evidence may be provided by having opposite lateral sides 60A, 60B of the lever 35 connected to the opposite sides "a", "b" of the flange 40 by a frangible or relatively weak strip or length of material. A space 65, generally large enough to accept one or more fingers, is preferably provided between the lower end/edge of the lever 50 and the lower flange piece "c" connecting the opposite sides of the flange "a", "b". In this regard, placement of the flange 40 near or proximal to the lower edge 50 of the lever 35 protects against unintentional activation or operation of the lever 35 during handling of the container 5. However, as the free or lower end 50 of the lever 35 is spaced a distance "d" from the flange 40 (the flange being positioned about the lateral edges, including the lower edge and opposite sides, of the lever) a user may insert a finger(s), tool, or other object between the lower edge of the lever 50 and the lower flange piece "c", so that the free end 50 of the lever 35 may be pulled laterally away from the container 5 to cause the pivoted end 55 to rotate about the lever's attachment point on the container 5 to disassociate the lid 30 from the container 5.

Although connection between the flange 40 the lower flange piece "c" is shown in the Figures as extending or being angled in a downward direction to accommodate the flange piece "c" being spaced a distance "d" from the lever 35, person of ordinary skill in the art will understand that flange piece "c" may be formed without such a "dip" in the flange 40 so as to be considered formed substantially straight or inline with the rest of the flange 40.

The continuous, unbroken, or uninterrupted manner in which the flange structure 40 (FIG. 1) is formed about the periphery of the container 5 further provides improved hoop strength when compared to a container having a discontinuous flange such as the one disclosed in the Mitchell '492 patent. In this regard, in one embodiment, the continuous flange 40 of the present invention provides a unified or unbroken structure which is a generally considered to be a more stable structure than a flange (reference 12 of the Mitchell '492 patent) having areas of discontinuity that are arguably weaker and more susceptible to load stresses, such as compression and/or lateral forces potentially imposed on the container during stacking, packing, or handling of the container.

In another embodiment, a discontinuous flange, handle, or similar structure (not shown) may be provided on the body 25 for lifting, handling, or otherwise maneuvering the container 5 while a partially or completely separate piece of material, similar to the lower flange piece "c" of FIG. 7 without being continuous with flange sides "a" and "b", may be positioned below the lower edge 50 of the lever 35. While this arrangement, as it would be considered discontinuous in nature, may not provide the added benefit of improved container hoop strength, it would still protect against unintentional activation or operation of the lever during handling of the container 5.

In one embodiment, a method for protecting against inadvertent opening of a lid of a container and lid assembly includes the steps of: (1) providing a closure displacement lever having a connected end and a free end; (2) pivotally attaching the connected end to a container; (3) configuring the lever to disengage a lid upon manipulation of the free by a user to pivot the lever about the connected end; and (4) positioning a flange on the container and spacing the flange a distance from the free end of the lever so as to protect against disengagement of the lid by inadvertent manipulation of the free end.

The apparatus and methods of the present invention have been described with some particularity, but the specific designs, constructions and steps disclosed are not to be taken as delimiting of the invention. Obvious modifications will make themselves apparent to those of ordinary skill in the art, all of which will not depart from the essence of the invention and all such changes and modifications are intended to be encompassed within the appended claims.

What is claimed is:

1. A container and lid, comprising:

a container having a top opening;

a lid configured to engage the top opening of the container, wherein the lid includes a downwardly-depending skirt;

a pull lever at an exterior of the container and having an upper connected end and a lower free end, wherein the pull lever is configured to disengage the lid body upon pulling of the free end by a user;

a flange at an exterior of the container, including first and second flange portions at first and second sides of the pull lever and a third flange portion below the pull lever and connecting the first and second flange portions;

a container bead at an exterior of the container; and a lid bead at an interior of the skirt configured to engage the container bead, wherein the pull lever is configured to disengage the lid bead from the container bead.

2. The container and lid of claim 1, wherein the lid includes a downwardly-projecting portion configured to contact an interior of the container.

3. The container and lid of claim 1, wherein the pull lever is configured to lift the skirt.

4. The container and lid of claim 1, wherein the flange is configured to make a close fit with a lower edge of the skirt.

5. The container and lid of claim 1, wherein the flange is below the container bead.

6. The container and lid of claim 1, wherein the free end of the pull lever is below an upper edge of the flange.

7. The container and lid of claim 1, wherein the connected end of the pull lever is above an upper edge of the flange.

8. A container and lid, wherein the container comprises:

a container body having a top opening;

a pull lever at an exterior of the container body and having an upper connected end and a lower free end;

a flange at an exterior of the container body, including first and second flange portions at first and second sides of the pull lever and a third flange portion below the pull lever and connecting the first and second flange portions; and a container bead at an exterior of the container body; and wherein the lid comprises:

a lid body configured to cover the top opening of the container body;

a downwardly depending skirt at a peripheral portion of the lid body; and a lid bead at an interior of the downwardly-depending skirt configured to hold the lid body to the container body by engaging the container bead, wherein the pull lever is configured to disengage the lid bead from the container bead upon pulling of the free end by a user.

9. The container and lid of claim 8, wherein a space between the third flange portion and the free end of the lever is large enough to accept one or more fingers.

10. The container and lid of claim 8, wherein the lid further comprises a downwardly-projecting portion configured to contact an interior of the container body.

11. The container and lid of claim 8, wherein the container further comprises a frangible material connecting between the pull lever and the flange.

12. The container and lid of claim 8, wherein the flange is continuous about the periphery of the container body.

13. The container and lid of claim 8, wherein the flange forms a U-shaped housing about the pull lever.

14. The container and lid of claim 8, wherein the container bead protrudes from the exterior of the container body.

15. The container and lid of claim 8, wherein the lid bead protrudes from the interior of the downwardly-depending skirt.

* * * * *